US010487777B2

(12) United States Patent
Yamazaki et al.

(10) Patent No.: US 10,487,777 B2
(45) Date of Patent: Nov. 26, 2019

(54) AIR LEADING-TYPE STRATIFIED SCAVENGING TWO-STROKE INTERNAL-COMBUSTION ENGINE

(71) Applicant: Yamabiko Corporation, Tokyo (JP)

(72) Inventors: Takahiro Yamazaki, Tokyo (JP); Hidekazu Tsunoda, Tokyo (JP); Hisato Osawa, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 13 days.

(21) Appl. No.: 14/874,507

(22) Filed: Oct. 5, 2015

(65) Prior Publication Data

US 2016/0097344 A1 Apr. 7, 2016

(30) Foreign Application Priority Data

Oct. 7, 2014 (JP) ..... 2014-206749
Oct. 7, 2014 (JP) ..... 2014-206750

(51) Int. Cl.

| | |
|---|---|
| ***F02F 3/24*** | (2006.01) |
| ***F02B 25/14*** | (2006.01) |
| ***F02B 75/02*** | (2006.01) |
| ***F02B 75/16*** | (2006.01) |
| ***F02B 25/02*** | (2006.01) |

(Continued)

(52) U.S. Cl.

CPC ..... *F02F 3/24* (2013.01); *F02B 25/02* (2013.01); *F02B 25/14* (2013.01); *F02B 75/02* (2013.01); *F02B 75/16* (2013.01); *F02B 2075/025* (2013.01); *F02F 1/22* (2013.01); *F02F 7/0004* (2013.01)

(58) Field of Classification Search

CPC .... F02B 2075/025; F02B 25/02; F02B 25/14; F02B 75/02; F02B 75/16; F02F 1/22; F02F 3/24; F02F 7/0004

USPC ..... 123/73 PP

See application file for complete search history.

(56) References Cited

U.S. PATENT DOCUMENTS 5,067,453 A 11/1991 Takashima
6,205,962 B1 * 3/2001 Berry, Jr. ..... F01M 1/08 123/193.6

(Continued)

OTHER PUBLICATIONS

Extended European Search Report issued in corresponding European Patent Application No. 15188711.4 dated Mar. 16, 2016 (6 pages).

*Primary Examiner* — Grant Moubry
*Assistant Examiner* — Ruben Picon-Feliciano
(74) *Attorney, Agent, or Firm* — Kilyk & Bowersox, P.L.L.C.

(57) ABSTRACT

The efficiency of charging air to a scavenging channel is enhanced by generating a gas flow in a piston groove simultaneously with the piston groove coming into communication with an air port. A piston groove 8 formed in a peripheral surface of a piston includes a pressure transmission through hole 10, and the pressure transmission through hole 10 consistently communicates with a crankcase. In the course of the piston moving up, upon a pressure in the crankcase becoming negative, the negative pressure in the crankcase affects the piston groove 8 through the pressure transmission through hole 10. Consequently, a pressure in the piston groove 8 is released to the crankcase through the pressure transmission through hole 10. Upon the piston moving up and the piston groove 8 being thereby brought into communication with the air port 4*a*, air enters the piston groove 8 through the air port 4*a* ((III) of FIG. 1).

3 Claims, 6 Drawing Sheets

(51) Int. Cl.
*F02F 1/22* (2006.01)
*F02F 7/00* (2006.01)

(56) References Cited

U.S. PATENT DOCUMENTS

| | | | | |
|---|---|---|---|---|
| 6,857,402 | B2 | 2/2005 | Schlossarczyk et al. | |
| 8,181,622 | B2 * | 5/2012 | Tsuchida | F01M 1/08 123/193.4 |
| 8,770,159 | B2 * | 7/2014 | Takayanagi | F02B 25/16 123/65 V |
| 2005/0139179 | A1 * | 6/2005 | Mavinahally | F01L 7/06 123/73 A |
| 2006/0266310 | A1 | 11/2006 | Yamaguchi | |
| 2010/0059030 | A1 * | 3/2010 | Ishida | F02B 25/14 123/73 R |
| 2011/0079206 | A1 | 4/2011 | Yamazaki et al. | |
| 2011/0146642 | A1 * | 6/2011 | Geyer | B22C 9/10 123/73 PP |
| 2011/0146643 | A1 * | 6/2011 | Geyer | F02B 25/14 123/73 PP |
| 2016/0097343 | A1 | 4/2016 | Yamazaki et al. | |

* cited by examiner

AIR LEADING-TYPE STRATIFIED SCAVENGING TWO-STROKE INTERNAL-COMBUSTION ENGINE

BACKGROUND OF THE INVENTION

The present application claims priority from Japanese Patent Applications No. 2014-206750 and No. 2014-206749, filed Oct. 7, 2014, which are incorporated herein by reference.

The present invention generally relates to a two-stroke internal-combustion engine and more specifically relates to an air leading-type engine that first induces air to flow into a combustion chamber in a scavenging stroke.

Two-stroke internal-combustion engines of the type in which scavenging is performed using air-fuel mixture are often used in portable work machines such as brush cutters and chain saws. This type of two-stroke internal-combustion engine includes a scavenging channel that brings a crankcase and a combustion chamber into communication with each other. Air-fuel mixture pre-compressed in the crankcase is induced to flow into the combustion chamber through the scavenging channel, and scavenging is performed by the air-fuel mixture.

As well-known, two-stroke engines have the problem of "air-fuel mixture (new gas) blow-by". In response to this problem, air leading-type stratified scavenging two-stroke internal-combustion engines have been proposed and already put into practical use (U.S. Pat. No. 6,857,402). In an air leading-type stratified scavenging engine, air is charged into a scavenging channel in advance. In a scavenging stroke, first, the air accumulated in the scavenging channel is induced to flow into a combustion chamber and then air-fuel mixture in a crankcase is induced to flow into the combustion chamber through the scavenging channel.

FIG. 8 is a diagram relating to opening/closing of a port in a conventional air leading-type stratified scavenging engine. In FIG. 8, in order to avoid confusion of drawn lines, illustration of a piston is omitted. In the figure, reference numeral 100 denotes a cylinder wall. In the cylinder wall 100, an air channel 102 and an air-fuel mixture channel (not shown) open. Air-fuel mixture is supplied to a crankcase through the air-fuel mixture channel. An air port of the air channel 102 is denoted by reference numeral 102*a*. Also, in the cylinder wall 100, a scavenging port 104*a* of a scavenging channel 104 opens. The scavenging channel 104 communicates with a crankcase. Each of the air port 102*a* and the scavenging port 104*a* is opened/closed by the piston. The piston has a groove 106 in a peripheral surface thereof. The piston groove 106 extends in a circumferential direction.

(I) to (III) of FIG. 8 chronologically illustrate states in the course of the piston moving up toward the top dead center. (II) of FIG. 8 indicates a state in which the piston moves up relative to the position in (I) of FIG. 8. (III) of FIG. 8 indicates a state in which the piston moves up relative to the position in (II) of FIG. 8.

Referring to (I) of FIG. 8, immediately before the piston groove 106 reaches the air port 102*a* after the piston moving up from the bottom dead center toward the top dead center, a gas blown back in previous scavenging is mixed in the piston groove 106. The blown-back gas contains air-fuel mixture components. The blown-back gas remaining in the piston groove 106 is indicated by dots. In (II) of FIG. 8, which illustrates a state in which the piston further moves up toward the top dead center, the piston groove 106 communicates with the air port 102*a*. In the state in (II) of FIG. 8, the piston groove 106 is not in communication with the scavenging port 104*a*. Therefore, even though the piston groove 106 communicates with the air port 102*a*, no air flow from the air port 102*a* to the piston groove 106 is generated at this point.

In (III) of FIG. 8, which illustrates a state in which the piston further moves up toward the top dead center, the piston groove 106 communicates with the air port 102*a* and also communicates with the scavenging port 104*a*. In this state in (III) of FIG. 8, air is charged into the scavenging channel 104.

In theory, in a conventional air leading-type stratified scavenging two-stroke internal-combustion engine, a flow of gas in the piston groove 106 occurs only when the piston groove 106 communicates with the scavenging port 104*a*. Then, the gas in the piston groove 106 first enters the scavenging channel 104, and then air enters from the air port 102*a* to the scavenging channel 104 through the piston groove 106 ((III) of FIG. 8). Therefore, a timing of the air entering the scavenging channel 104 from the piston groove 106 is later than a timing of the piston groove 106 starting communicating with the scavenging channel 104.

As well-known, a two-stroke internal-combustion engine for a work machine is run at a high rotation rate of, for example, 10,000 rpm. Therefore, the aforementioned timing delay largely affects the efficiency of air charge into a scavenging channel 104. More specifically, two-stroke internal-combustion engines for work machines have the essential problem of difficulty in ensuring the certainty of charging air into the scavenging channel 104 in each cycle. In order to address this problem, in reality, conventional air leading-type stratified scavenging two-stroke internal-combustion engines employ a configuration in which a timing for a piston groove 106 to come into communication with a scavenging port 104*a* is substantially advanced. However, employment of this configuration results in air-fuel mixture components remaining in a gas scavenging channel 104 easily flowing to the air channel 102 side, which causes decrease in emission characteristic improvement effect.

An object of the present invention is to provide an air leading-type stratified scavenging two-stroke internal-combustion engine that can enhance the efficiency of charging air to a scavenging channel by generating a gas flow in a piston groove simultaneously with the piston groove coming into communication with an air port.

SUMMARY OF THE INVENTION

The aforementioned object can be achieved by the present invention providing an air leading-type stratified scavenging two-stroke internal-combustion engine including:

an air port that opens in a cylinder wall and is opened/closed by a piston;

a scavenging channel including a scavenging port that opens in the cylinder wall and is opened/closed by the piston, the scavenging channel communicating with a crankcase; and a piston groove formed in a peripheral surface of the piston, the piston groove enabling the air port and the scavenging port to communicate with each other, wherein the piston groove includes a pressure transmission through hole that communicates with the crankcase.

FIG. 1 is a diagram for describing a main concept of the present invention. With reference to FIG. 1, reference numeral 2 denotes a cylinder wall, which corresponds to the cylinder wall 100 in FIG. 8. Reference numeral 4 in FIG. 1 denotes an air channel, and reference numeral 4*a* denotes an air port, the air channel 4 and the air port 4*a* corresponding to the air channel 102 and the air port 102*a* illustrated in FIG. 8. Reference numeral 6 in FIG. 1 denotes a scavenging channel, and reference numeral 6*a* denotes a scavenging port, the scavenging channel 6 and the scavenging port 6*a* corresponding to the scavenging channel 104 and the scavenging port 104*a* illustrated in FIG. 8. Reference numeral 8 in FIG. 1 denotes a piston groove, which corresponds to the piston groove 106 in FIG. 8.

Also with reference to FIG. 1, the piston groove 8 includes a relatively-small pressure transmission through hole 10 as a pressure transmission port, and the pressure transmission through hole 10 consistently communicates with a crankcase. (I) to (IV) of FIG. 1 chronologically illustrate states in the course of a piston moving up toward the top dead center. (II) of FIG. 1 illustrates a state in which the piston moves up relative to the position in (I) of FIG. 1. (III) of FIG. 1 illustrates a state in which the piston moves up relative to the position in (II) of FIG. 1. (IV) of FIG. 1 illustrates a state in which the piston moves up relative to the position in (III) of FIG. 1.

Upon a pressure in the crankcase becoming negative in the course of the piston moving up from (I) to (II) of FIG. 1, the negative pressure in the crankcase affects the piston groove 8 through the pressure transmission through hole 10. Consequently, a pressure in the piston groove 8 is released to the crankcase through the pressure transmission through hole 10. Therefore, upon the piston groove 8 coming into communication with the air port 4*a*, a gas flow is generated in the piston groove 8, and air enter the piston groove 8 through the air port 4*a* ((III) of FIG. 1). Then, simultaneously with the piston groove 8 coming into communication with the scavenging port 6*a*, air is supplied from the air channel 4 to the scavenging channel 6 through the piston groove 8 ((IV) of FIG. 1).

The present invention enables enhancement in efficiency of charging air into the piston groove 8 and also enables air to be charged into the scavenging channel 6 simultaneously with the piston groove 8 coming into communication with the scavenging port 6*a*.

A function of the scavenging port 6*a* is the same as that of a scavenging port in a conventional air leading-type stratified scavenging two-stroke internal-combustion engine. In a scavenging stroke, first, air accumulated in the scavenging channel 6 is discharged from the scavenging port 6*a* to a combustion chamber, and subsequently air-fuel mixture in the crankcase is discharged to the combustion chamber.

According to the present invention, a flow of gas in a piston groove can be generated simultaneously with the piston groove coming into communication with an air port. Consequently, the efficiency of charging air into a scavenging channel through the piston groove can be enhanced.

As stated above, a two-stroke internal-combustion engine for a work machine is run at a high rotation rate of, for example, 10,000 rpm. The present invention enables enhancement of the certainty of charging air to a scavenging channel in each cycle in such engine.

Other objects of the present invention and operation and effects of the present invention will be clarified from the following detailed description of a preferable embodiment of the present invention.

DETAILED DESCRIPTION OF THE PRESENT INVENTION

A preferable embodiment of the present invention will be described below with reference to the attached drawings.

Figure 1:
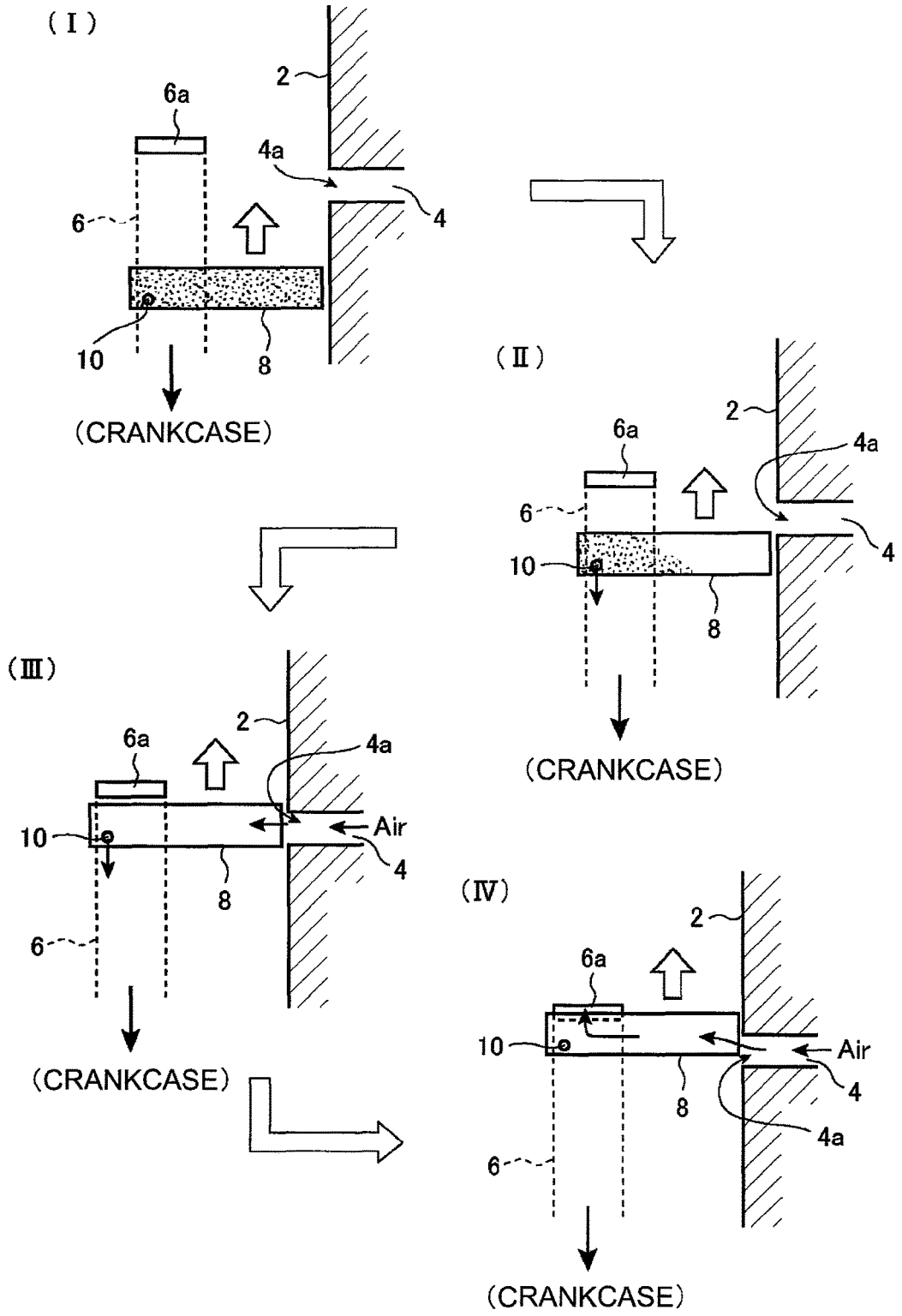
FIG. 1 is a diagram for describing a configuration and operation of a main concept of the present invention: (I) illustrates a state in which a piston starts moving up from the bottom dead center toward the top dead center; (II) illustrates a state in which the piston further moves up toward the top dead center; (III) illustrates a state in which the piston further moves up and a piston groove is thereby brought into communication with an air port; and (IV) illustrates a state in which the piston further moves up and the piston groove that is in communication with the air port is thereby brought into communication with a scavenging port.
Figure 2:
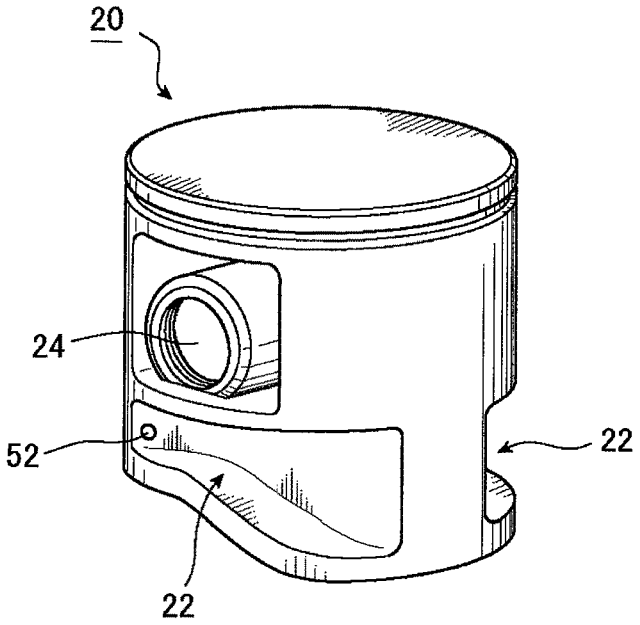
FIG. 2 is a perspective view of a piston included in an air leading-type stratified scavenging two-stroke internal-combustion engine according to an embodiment of the present invention.

FIG. 2 illustrates a piston included in an air leading-type stratified scavenging two-stroke internal-combustion engine according to an embodiment of the present invention. With reference to FIG. 2, a piston 20 includes piston grooves 22 in a peripheral surface thereof. The piston 20 includes a piston pin hole 24, and a piston pin (not shown) inserted through the piston pin hole 24 is connected to a connecting rod (not shown).

Figure 3:
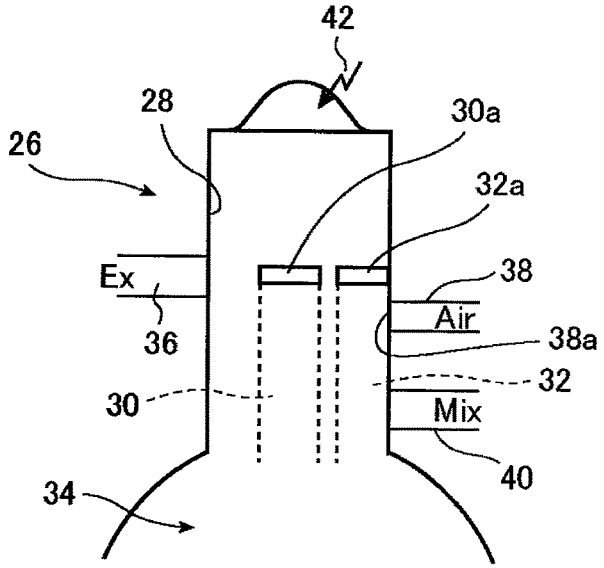
FIG. 3 is a diagram for describing a configuration of a cylinder included in an air leading-type stratified scavenging two-stroke internal-combustion engine according to the embodiment of the present invention.

The piston 20 is fitted in a cylinder 26, which is illustrated in FIG. 3, so as to be vertically and reciprocatably movable. The cylinder 26 includes first and second scavenging channels 30 and 32 in each of the left and the right sides in plan view, and the first and second scavenging channels 30 and 32 communicate with a crankcase 34. In the cylinder wall 28, first and second scavenging ports 30*a* and 32*a* open. The first scavenging ports 30*a* communicate with the respective first scavenging channels 30. The second scavenging ports 32*a* communicate with the respective second scavenging channels 32. In other words, the engine according the embodiment is a four-flow scavenging engine.

In the figure, reference numeral 36 denotes an exhaust channel. Also, reference numeral 38 denotes an air channel. Also, reference numeral 40 denotes an air-fuel mixture channel. Air is supplied to the air channel 38. Air-fuel mixture produced by a carburetor (not shown) is supplied to the air-fuel mixture channel 40. Reference numeral 42 denotes a spark plug.

Figure 4:
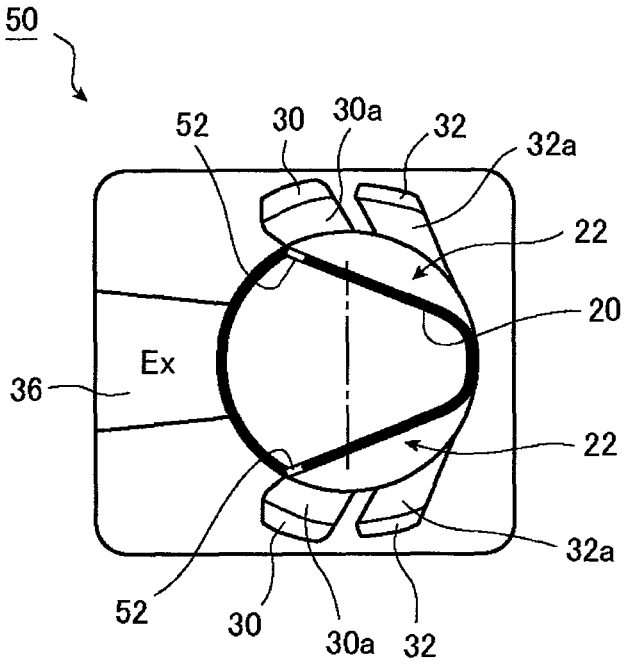
FIG. 4 is a horizontal cross-sectional view of the air leading-type stratified scavenging two-stroke internal-combustion engine according to the embodiment of the present invention, cut along a level of a height of an exhaust channel thereof.

FIG. 4 is a horizontal cross-sectional view of an air leading-type stratified scavenging two-stroke internal-combustion engine 50 according to the embodiment of the present invention. Referring to FIG. 4, a first scavenging port 30*a* and a second scavenging port 32*a* positioned in each of the left and the right sides are oriented in a direction opposite to the exhaust channel 36. In other words, the two-stroke internal-combustion engine 50 according to the embodiment is a loop scavenging engine.

Figure 5:
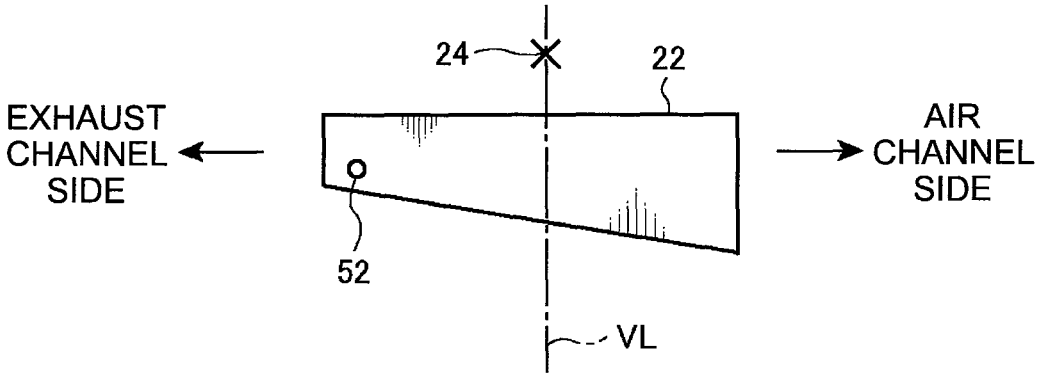
FIG. 5 is a front view of a piston groove included in the piston illustrated in FIG. 2.

Referring back to FIG. 2, the piston grooves 22 extend in a circumferential direction of the piston 20. FIG. 5 is a front view of a piston groove 22. Referring to FIGS. 2 and 5, the piston grooves 22 each includes a pressure transmission through hole 52.

The pressure transmission through holes 52 may have a diameter of 0.1 to 3.0 mm, preferably a diameter of 0.5 to 2.5 mm, most preferably a diameter of 1.0 to 2.0 mm. In the embodiment, the pressure transmission through holes 52 are arranged in respective downstream ends in an air flow direction of the respective piston grooves 22, that is, left ends (ends on the exhaust port side) in FIG. 5, and positioned in the lower side of the respective piston grooves 22 in front view of the piston grooves 22.

Although each pressure transmission through hole 52 may be arranged at an arbitrary position in the relevant piston groove 22, it is effective to arrange the pressure transmission through holes 52 on the downstream side in the air flow direction of the piston grooves 22. With reference to FIG. 5, the alternate long and short dash line is a vertical line VL running across the piston pin hole 24. More specifically, arrangement of the pressure transmission through holes 52 on the downstream side relative to the vertical line VL running across the piston pin hole 24 (the left side in FIG. 5) is effective for generating an initial gas flow inside the piston grooves 22.

In other words, the piston grooves 22 extend in the circumferential direction of the piston 20. The pressure transmission through holes 52 are disposed at respective positions adjacent to the respective first scavenging ports 30*a* positioned on the exhaust port side.

Figure 6:
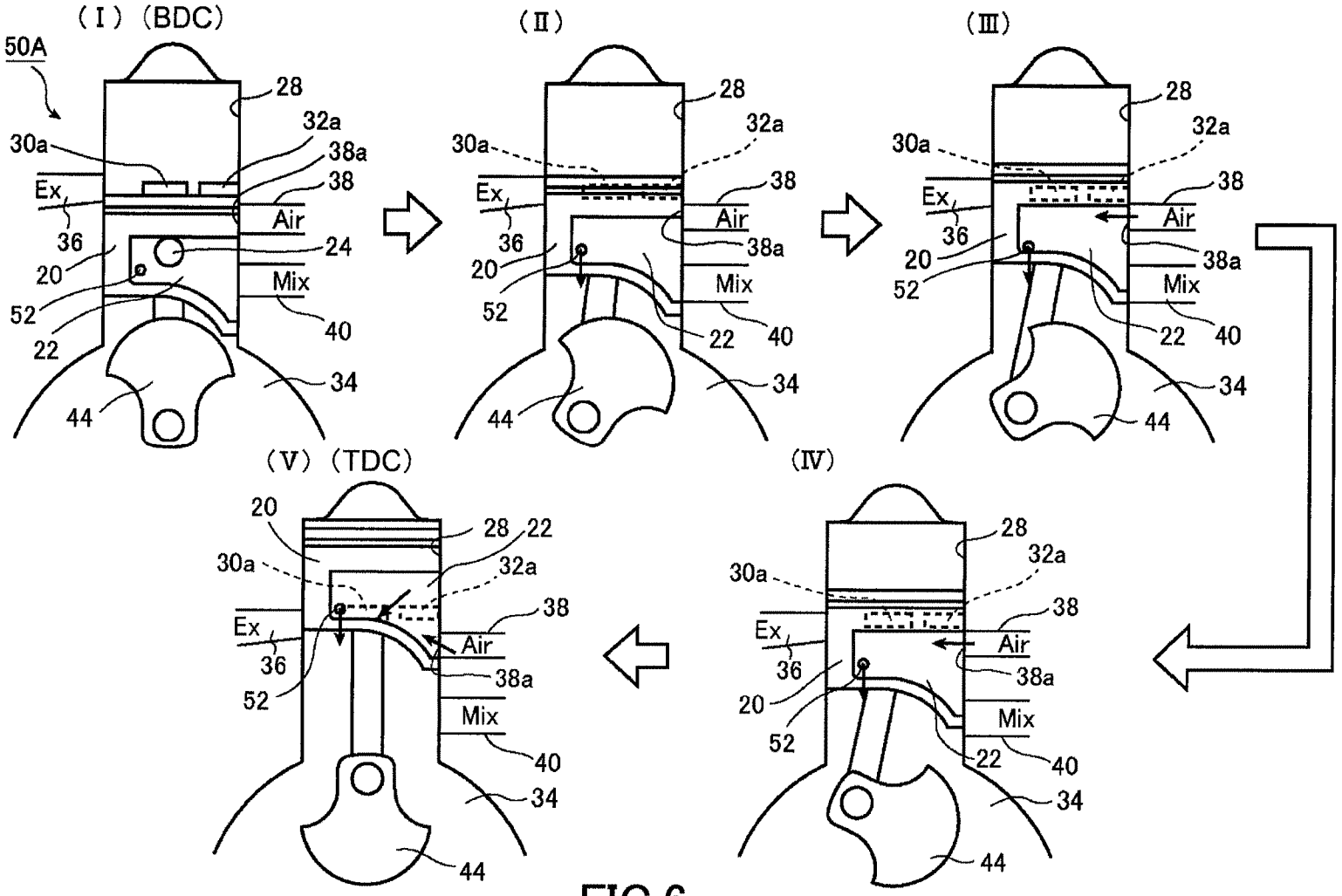
FIG. 6 is a diagram for describing states in the course of piston upward movement toward the top dead center in a two-stroke engine according to the embodiment including a piston with a piston groove having a relatively-large vertical width: (I) illustrates a state in which the piston is positioned at the bottom dead center; (II) illustrates a state in which the piston moves up from the bottom dead center toward the top dead center; (III) illustrates a state in which the piston further moves up and piston grooves are thereby brought into communication with an air port; (IV) illustrates a state in which the piston further moves up toward the top dead center; and (V) illustrates a state in which the piston is positioned at the top dead center.
Figure 7:
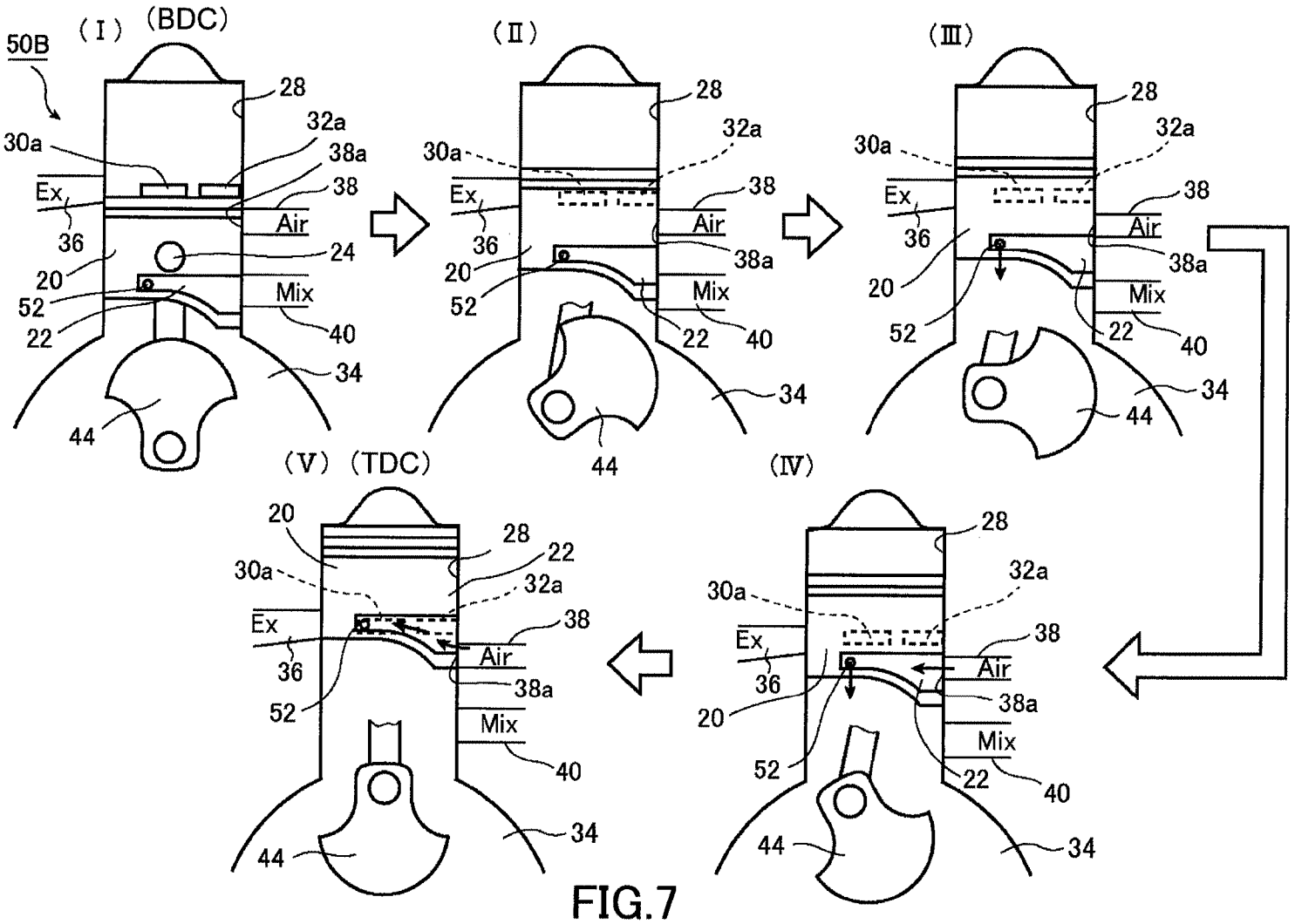
FIG. 7 is a diagram for describing states in the course of piston upward movement toward the top dead center in a two-stroke engine according to the embodiment including a piston with a piston groove having a relatively-small vertical width: (I) illustrates a state when a piston is positioned at the bottom dead; (II) illustrates a state in which the piston moves up from the bottom dead center toward the top dead center; (III) illustrates a state immediately after the piston further moves up and a piston groove comes into communication with an air port; (IV) illustrates a state in which the piston further moves up toward the top dead center and the piston groove comes into communication with an air port; and (V) illustrates a state in which the piston is positioned at the top dead center.
Figure 8:
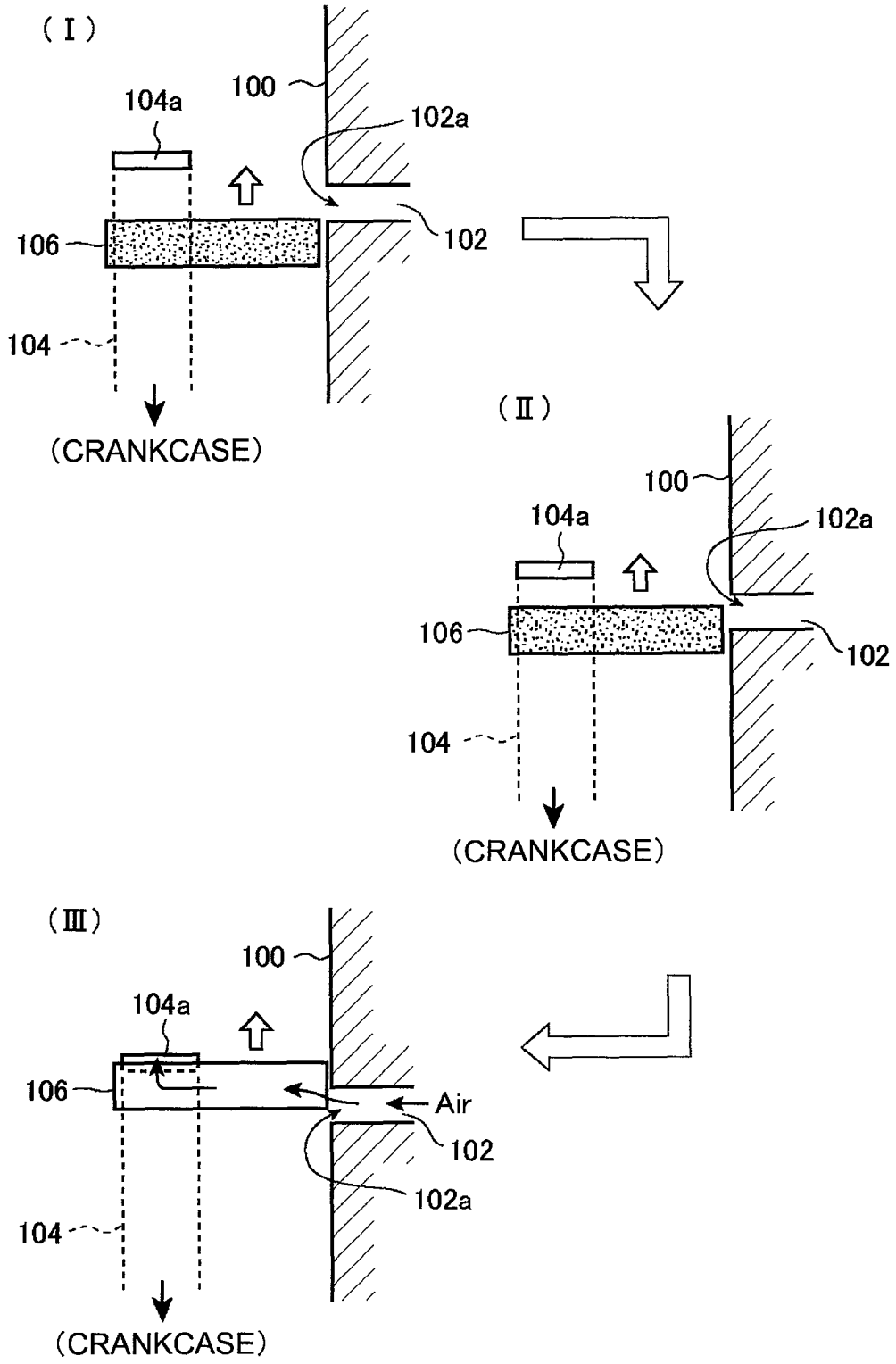
FIG. 8 is a diagram for describing states in the course of piston upward movement toward the top dead center in a conventional air leading-type stratified scavenging two-stroke engine: (I) indicates a state immediately before a piston groove comes into communication with an air port; (II) indicates a state in which a piston moves up and the piston groove is thereby brought into communication with the air port; and (III) indicates a state in which the piston further moves up and the piston groove that is in communication with the air port is thereby brought into communication with a scavenging port.

FIGS. 6 and 7 each indicate a specific example in which in the course of the piston moving up toward the top dead center, air is supplied to the scavenging channels 30 and 32 through the piston grooves 22. In the figures, reference numeral 44 denotes a crankshaft. An engine 50A, which is illustrated in FIG. 6, has a configuration in which the piston grooves 22 are enlarged upward in order to increase respective volumes thereof. In an engine 50B, which is illustrated in FIG. 7, the piston grooves 22 are positioned below the piston pin hole 24. A vertical width of the piston grooves 22 is smaller than that of the piston grooves 22 illustrated in FIG. 6.

The engine 50A illustrated in FIG. 6, which includes piston grooves 22 each having a relatively-large vertical width, will be described. (I) of FIG. 6 illustrates the piston 20 positioned at the bottom dead center. Upon the piston 20 moving up from the bottom dead center toward the top dead center, a pressure in the crankcase 34 becomes negative. The negative pressure in the crankcase 34 affects the piston grooves 22 through the pressure transmission through holes 52 ((II) of FIG. 6). The piston 20 further moves up toward the top dead center and the piston grooves 22 is thereby brought into communication with an air port 38*a*. Then, air in the air channel 38 is drawn into the piston grooves 22 ((III) of FIG. 6). In other words, upon the piston grooves 22 coming into communication with the air port 38*a*, a gas flow is generated in each of the piston grooves 22. This state continues until the piston grooves 22 come into communication with the first and second scavenging ports 30*a* and 32*a* ((IV) of FIG. 6).

Upon the piston 20 further moving up toward the top dead center after the above period in which the piston grooves 22 come into communication with the air port 38*a*, the piston grooves 22 that are in communication with the air port 38*a* are thereby brought into communication with the first and second scavenging ports 30*a* and 32*a*. Consequently, the air already charged in each of the piston grooves 22 is supplied to the relevant first and second scavenging channels 30 and 32. Also, air is supplied from the air channel 38 to the first and second scavenging channels 30 and 32 through the piston grooves 22. This state in which the air port 38*a* communicates with the first and second scavenging ports 30*a* and 32*a* via the piston grooves 22 continues until the piston 20 reaches the top dead center ((V) of FIG. 6).

The engine 50B in FIG. 7, which includes piston grooves 22 each having a relatively-small vertical width, will be described. (I) of FIG. 7 illustrates the piston 20 positioned at the bottom dead center. Upon the piston 20 moving up from the bottom dead center toward the top dead center, a pressure in the crankcase 34 becomes negative. The negative pressure in the crankcase 34 affects the piston grooves 22 through the pressure transmission through holes 52 ((II) of FIG. 7). This state continues until the piston 20 further moves up toward the top dead center and the piston grooves 22 are thereby brought into communication with the air port 38*a* ((III) of FIG. 7).

Upon the piston 20 further moving up toward the top dead center and the piston grooves 22 being thereby brought into communication with the air port 38*a*, air in the air channel 38 is drawn into the piston grooves 22. In other words, upon the piston grooves 22 coming into communication with the air port 38*a*, a gas flow is generated in each of the piston grooves 22. This state is continued until the piston grooves 22 come into communication with the first and second scavenging ports 30*a* and 32*a* ((IV) of FIG. 7). Then, upon the piston 20 further moving up toward the top dead center and the piston grooves 22 are thereby brought into communication with the first and second scavenging ports 30*a* and 32*a*, the air already charged in each of the piston grooves 22 is supplied to the relevant first and second scavenging channels 30 and 32. Also, air in the air channel 38 is supplied to the first and second scavenging channels 30 and 32 through the piston grooves 22. This state in which the air port 38*a* communicates with the first and second scavenging ports 30*a* and 32*a* via the piston grooves 22 continues until the piston 20 reaches the top dead center ((V) of FIG. 7).

In the engines 50A (FIG. 6) and 50B (FIG. 7) according to the embodiment of the present invention, at a stage prior to the piston grooves 22 coming into communication with the first and second scavenging ports 30*a* and 32*a*, the negative pressure in the crankcase 34 affects the piston grooves 22 through the pressure transmission through holes 52. Consequently, a gas flow is generated in each of the piston grooves 22. Then, this gas flow induces the action of air being sucked into the piston grooves 22 when the piston grooves 22 come into communication with the air port 38*a*. Consequently, simultaneously with the piston grooves 22 coming into communication with the air port 38*a*, air is drawn into the piston grooves 22 from the air port 38*a*. After this period in which the piston grooves 22 come into communication with the air port 38*a*, upon the piston grooves 22 that are in communication with the air port 38*a* come into communication with the scavenging ports 30*a* and 32*a*, air is immediately charged into the scavenging channels 30 and 32 through the piston grooves 22. Consequently, the efficiency of charging air to the scavenging channels 30 and 32 can be enhanced.

In other words, an engine according to the embodiment enables induction of an initial action of supplying air to scavenging ports 30*a* and 32*a* through piston grooves 22 that are in communication with an air port 38*a*. Consequently, the certainty of charging air to scavenging channels 30 and 32 in each cycle can be enhanced.

This means that the enhancement contributes to optimization of a timing for bringing the piston grooves and the scavenging ports into communication with each other and a timing for bringing the piston grooves and the air port into communication with each other. Consequently, an air leading-type stratified scavenging two-stroke internal-combustion engine with an output enhanced while exhaust gas emission characteristics are improved can be provided.

Although the embodiment has been described in terms of an engine with two scavenging ports 30*a* and 32*a* on each side and the two scavenging ports 30*a* and the two scavenging ports 32*a* on the opposite sides are symmetrically arranged, respectively, as a typical example, it should be understood that the present invention is not limited to this example. The present invention includes, for example, the following alterations:

(1) Engine including one scavenging port on each side;

(2) Engine with one or more scavenging ports on the respective sides arranged asymmetrically; and (3) Engine with a plurality of scavenging ports on each side, the scavenging ports being connected to, for example, one scavenging channel extending in a Y shape while a plurality of scavenging ports 30*a* and 32*a* on each side, the scavenging ports 30*a* and 32*a* being connected to independent scavenging channels 30 and 32 in the embodiment, are provided.

The present invention is applicable to an air leading-type stratified scavenging two-stroke internal-combustion engine. The present invention is favorable for use in a single-cylinder air-cooled engine to be mounted on a portable work machine such as a brush cutter or a chain saw.

20 piston
22 piston groove
24 piston pin hole
VL vertical line running across piston pin hole
26 cylinder
28 cylinder wall
30 first scavenging channel
30*a* first scavenging port
32 second scavenging channel
32*a* second scavenging port
34 crankcase
36 exhaust channel
38 air channel
38*a* air port
40 air-fuel mixture channel
50 air leading-type stratified scavenging two-stroke internal-combustion engine
52 pressure transmission through hole

What is claimed is:

1. An air leading-type stratified scavenging two-stroke internal-combustion engine comprising:

an air port that opens in a cylinder wall and is opened/closed by a piston;

a scavenging channel including a scavenging port that opens in the cylinder wall and is opened/closed by the piston, the scavenging channel directly communicating with a crankcase; and a piston groove formed in a peripheral surface of the piston to supply air received directly from the air port to the scavenging port in a scavenging process, the piston groove directly communicating with the scavenging port when the piston groove enables the air port and the scavenging port to communicate with each other to charge air into the scavenging channel through the air port, wherein the piston groove includes a pressure transmission through hole that directly communicates with the crankcase, wherein when a pressure in the crankcase becomes negative in the course of the piston moving up from the bottom dead center toward the top dead center, the negative pressure in the crankcase affects the piston groove through the pressure transmission through hole to release a pressure in the piston groove to the crankcase through the pressure transmission through hole prior to charging air into the scavenging channel, wherein the piston groove extends in a circumferential direction of the piston; and wherein the pressure transmission through hole is disposed in an end portion on the side of the piston groove, the side being opposite to the air port across a vertical line running across a piston pin hole in the piston, and wherein in a course of the piston moving up toward the top dead center, there is a period in which the piston groove is in communication with the air port but not in communication with the scavenging port.

2. The air leading-type stratified scavenging two-stroke internal-combustion engine according to claim 1, wherein the pressure transmission through hole is disposed on a downstream side in an air flow direction of the piston groove.

3. The air leading-type stratified scavenging two-stroke internal-combustion engine according to claim 1, wherein a plurality of the scavenging ports are disposed on a side of the engine; and wherein at a position adjacent to a scavenging port that is furthest from the air port from the plurality of scavenging ports, the pressure transmission through hole is disposed.

* * * * *